US011390479B2

(12) United States Patent
Adami

(10) Patent No.: US 11,390,479 B2
(45) Date of Patent: Jul. 19, 2022

(54) UNWINDER FOR ROLLS OF PAPER AND SIMILAR

(71) Applicant: Guangdong Fosber Intelligent Equipment Co., Ltd., Foshan (CN)

(72) Inventor: Mauro Adami, Viareggio (IT)

(73) Assignee: Guangdong Fosber Intelligent Equipment Co., Ltd., Guandong Province (CN)

( * ) Notice: Subject to any disclaimer, the term of this patent is extended or adjusted under 35 U.S.C. 154(b) by 139 days.

(21) Appl. No.: 16/925,610

(22) Filed: Jul. 10, 2020

(65) Prior Publication Data

US 2021/0032060 A1 Feb. 4, 2021

(30) Foreign Application Priority Data

Jul. 31, 2019 (IT) ..... 102019000013419

(51) Int. Cl.
*B65H 19/12* (2006.01)
*B65H 19/18* (2006.01)

(52) U.S. Cl.
CPC ..... *B65H 19/126* (2013.01); *B65H 19/1815* (2013.01); *B65H 19/1863* (2013.01); *B65H 2301/412* (2013.01); *B65H 2301/413* (2013.01); *B65H 2301/415* (2013.01); *B65H 2408/221* (2013.01)

(58) Field of Classification Search
CPC ..... B65H 19/126; B65H 19/1815; B65H 19/1863; B65H 2301/412; B65H 2301/413; B65H 2301/415; B65H 2408/221
See application file for complete search history.

(56) References Cited

U.S. PATENT DOCUMENTS

| | | | | |
|---|---|---|---|---|
| 3,740,296 | A * | 6/1973 | McDonald | B65H 19/00 242/555.4 |
| 3,863,854 | A * | 2/1975 | Tokuno | B65H 19/1815 242/555.4 |
| 6,786,264 | B1 | 9/2004 | Torres Martinez | |
| 6,966,961 | B2 | 11/2005 | Adami | |
| 7,441,579 | B2 | 10/2008 | Adami | |
| 8,011,409 | B2 | 9/2011 | Adami | |
| 2017/0275116 | A1 | 9/2017 | Gnan | |
| 2017/0291784 | A1 | 10/2017 | Adami | |

FOREIGN PATENT DOCUMENTS

| | | | |
|---|---|---|---|
| EP | 0341642 | A2 | 11/1989 |
| EP | 1348658 | A1 | 10/2003 |
| EP | 1770038 | A2 | 4/2007 |
| EP | 1770038 | A3 | 3/2008 |
| GB | 2217690 | A | 11/1989 |

* cited by examiner

*Primary Examiner* — Sang K Kim
(74) *Attorney, Agent, or Firm* — Breiner & Breiner, L.L.C.

(57) ABSTRACT

An unwinder (1) of rolls (B1, B2) including a bearing structure (3) and two pairs of arms (11A, 11B; 13A, 13B) supported movable on the bearing structure (3). The unwinder further includes a splicing machine (31). The bearing structure (3) includes a base (5) and an upright (7) extending from the base, on which a cross member (33) is supported. The cross member (33) includes an intermediate portion (33A) rigidly bound to the upright (7) and a pair of lateral supports (33B, 33C) adapted to assume at least one operating position and one non-operating position, with respect to the inter-mediate portion (33A) of the cross member (33).

16 Claims, 12 Drawing Sheets

UNWINDER FOR ROLLS OF PAPER AND SIMILAR

TECHNICAL FIELD

The present invention relates to improvements to unwinders for unwinding rolls of web material, such as rolls of paper or similar.

BACKGROUND ART

In many industrial sectors it is necessary to unwind rolls of web material to feed one or more continuous strips or sheets to a processing line. Typically, rolls of paper are used to feed lines for the production of corrugated board. For this purpose, unwinders are used that support one or more rolls of web material, which are put to work sequentially. To allow the production line to operate continuously, the unwinders usually have two pairs of roll-support arms, to support a working roll and a roll in standby. A splicing machine, usually mounted on a structure overhanging the un-winder, automatically joins the tail of the web material unwound from the working roll with the head of the web material wound around the roll in standby.

Examples of unwinders, particularly useful for feeding paper to corrugated board production lines are disclosed in U.S. Pat. Nos. 6,966,961; 7,441,579; US2017/0291784; U.S. Pat. No. 8,011,409; EP0341642; U.S. Pat. No. 6,786,264; EP1348658. These unwinders are also fitted with splicing machines, i.e. with devices whose job is to join the tail of a first web material with the head of a second web material.

The transport and installation of these machines on the production line are long, complex operations, requiring considerable specialist labor. The splicing machine and the unwinder are usually transported separately. The splicing machine and the unwinder are then installed, wired and tested before being able to start up the production line. Typically, there is a bearing structure with uprights and cross members, to which the splicing machine is applied. To do so, specific lifting members are provided to raise the splicing machine up to the height of the cross members of the bearing structure. Then, when the splicing machine has been anchored to the bearing structure and the lifting members have been disassembled and removed, sufficient space is created to install the unwinder under the splicing machine. Once this double installation has been completed, all mechanical, electrical and pneumatic connections need to be made. Lastly, the unwinder/splicing machine assembly needs to be tested.

These operations are long and complex.

It would be beneficial, both for the machine manufacturer, and for the user, to have systems adapted to simplify, facilitate and speed up these operations, thereby also reducing the amount of specialist labor required to carry them out.

SUMMARY

A roll unwinder comprising a bearing structure and two pairs of arms supported movable on the bearing structure is provided. Each arm comprises members for axial engagement of a roll, for example tailstocks. The unwinder also comprises a splicing machine. Advantageously, the splicing machine is integrated in the bearing structure of the unwinder, so as to be supported by it. In particular, the bearing structure may advantageously comprise a base and an upright extending from the base, on which a cross member is supported. The cross member comprises an intermediate portion rigidly bound to the upright and a pair of articulated lateral supports, adapted to take at least one operating position and one non-operating position, with respect to the intermediate portion of the cross member.

In this way, the unwinder becomes an integrated machine, to the bearing structure of which are fixed both the support and manipulation arms for the rolls to be unwound, and the splicing machine. The cross member, divided into three portions, can be folded into a position taking a minimal amount of space, for example for transport.

This thereby offers the possibility of assembling the entire unwinder, including the splicing machine, while also making the electrical, hydraulic and pneumatic connections between the various components, if required. The entire unwinder can thus be assembled and tested by the manufacturer before shipping to the end customer. After assembly, connection and testing, without dismantling important portions of the unwinder, but possibly only some secondary components, the cross member can be folded into a position taking a minimal amount of space, in order to facilitate transportation of the machine to the place where it will be used. Here, performing the operations in reverse, the cross member is extended into the operating position and, without the need for external bearing structures or lifting members, the unwinder with the integrated splicing machine is installed by means of simple, quick operations that do not require any particular technical expertise.

Furthermore, since the main components of the unwinder have been assembled, wired and tested, and not dismantled or disconnected afterwards, the unwinder does not need to be subjected to a further testing phase.

In embodiments described here, the splicing machine is supported by the cross member and comprises parts movable along said cross member.

In advantageous embodiments, in the operating position, the lateral supports of the cross member are aligned with the intermediate portion. Conversely, in the non-operating position, the lateral supports are turned towards the base of the bearing structure of the unwinder, in a position taking a minimal amount of space.

The arms of each pair of arms are connected to the bearing structure around a respective rotation axis. Preferably, there are two rotation axes parallel to one another, one for each pair of arms. When the unwinder is in the working position, the axes are substantially horizontal.

In advantageous embodiments, the arms are carried by slides movable on beams pivoting around the rotation axes and supported by the base of the bearing structure of the unwinder. In this way, the arms of each pair of arms can be movable, with respect to the bearing structure, in a direction parallel to the rotation axes.

The lateral supports of the cross member can advantageously be hinged to the upright, or to the intermediate portion of the cross member, around axes parallel to the rotation axes of the arms. The lateral supports can have a rotation movement, or a combined rotary-translation movement, with respect to the central portion of the cross member and/or with respect to the upright of the bearing structure. In other embodiments, the lateral supports may have a translation-only movement, for example in a telescopic configuration.

Further advantageous features and embodiments of the unwinder according to the invention are described below and defined in the accompanying claims, which form an integral part of the present description.

BRIEF DESCRIPTION OF DRAWINGS

The invention will be better understood by following the description and accompanying drawings, which illustrate by way of example a non-limiting embodiment of the invention. Specifically, with reference to the drawings.

DETAILED DESCRIPTION

Figure 1:
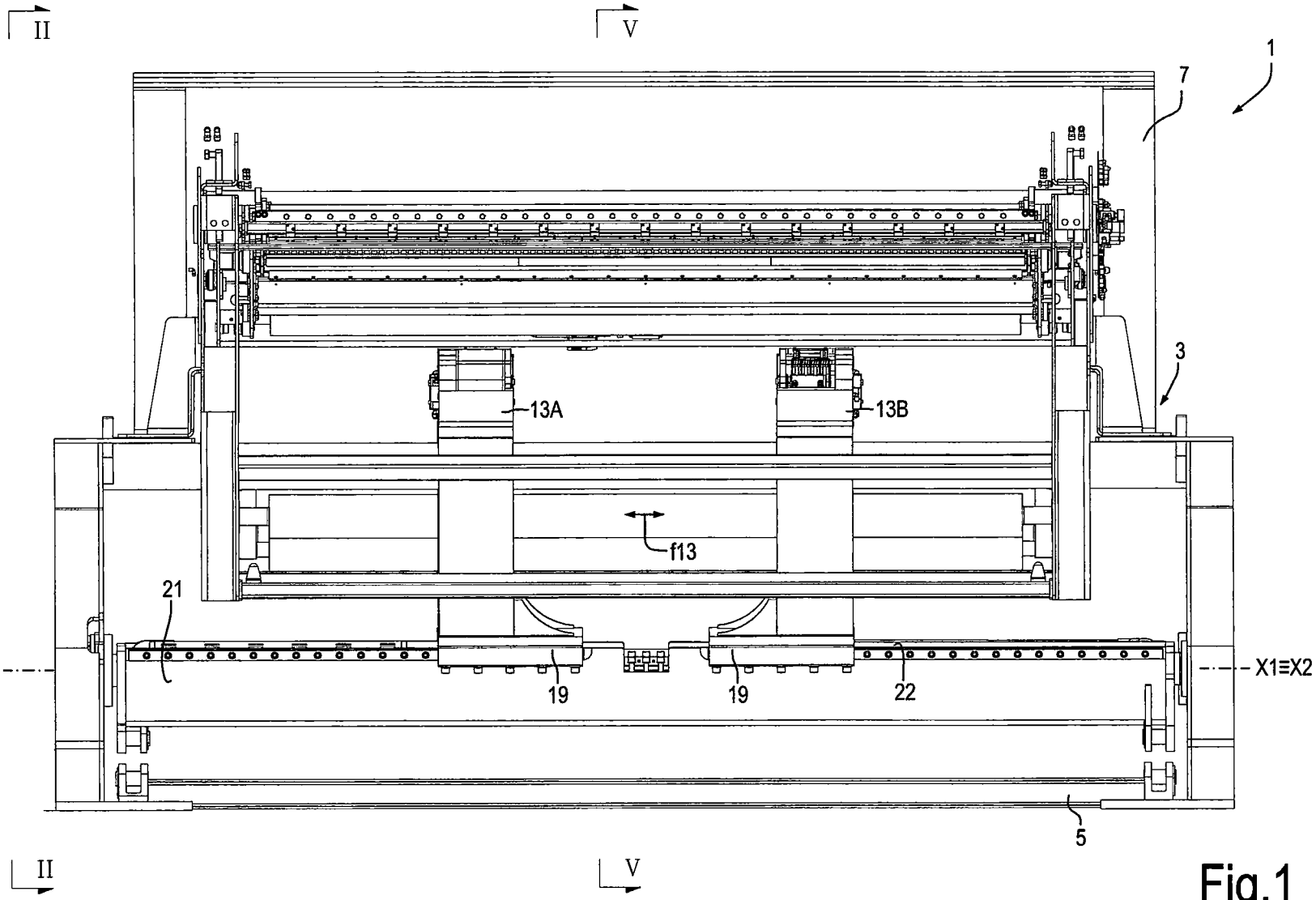
FIG. 1 shows a front view of an unwinder with relative integrated splicing machine, in a folded position.
Figure 2:
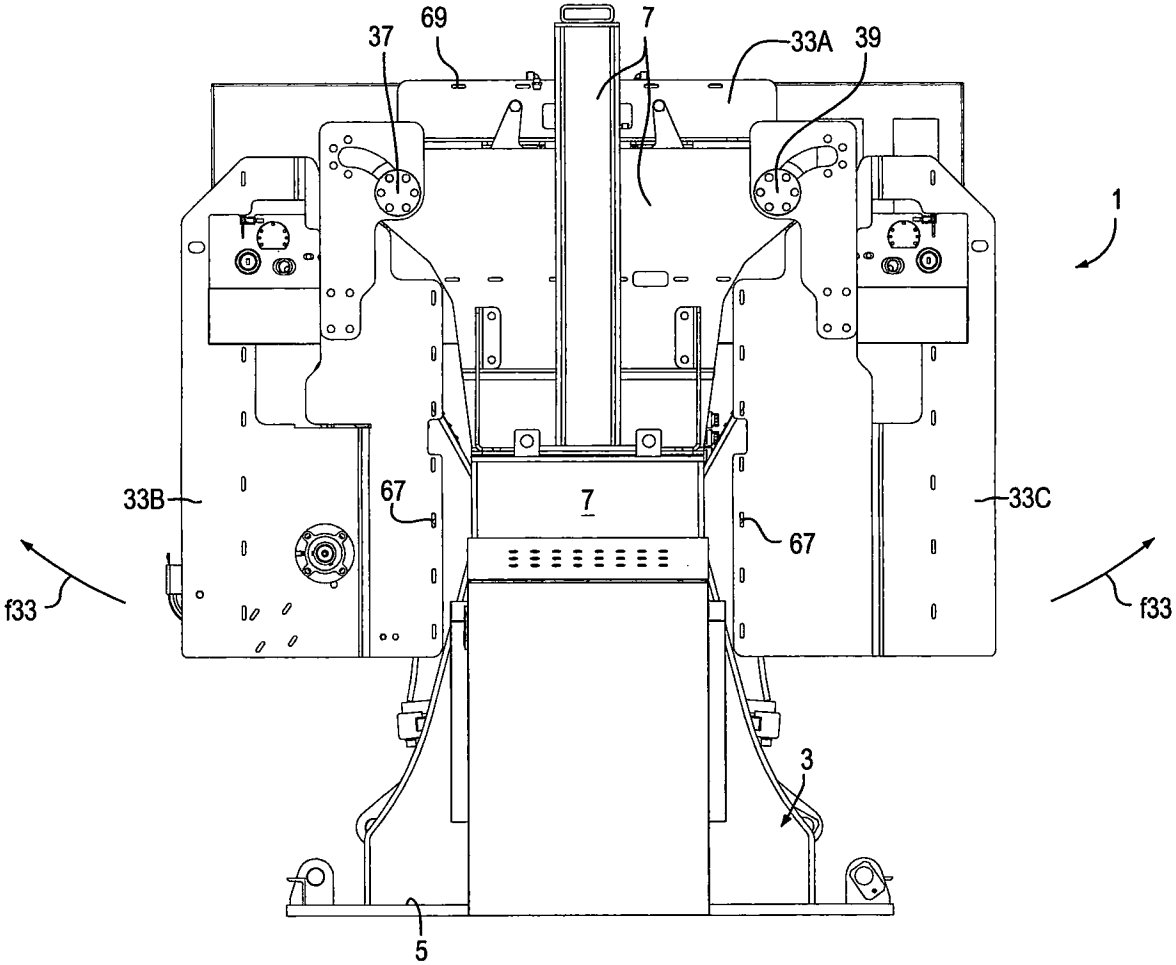
FIG. 2 shows a side view along the line II-II of FIG. 1.
Figure 3:
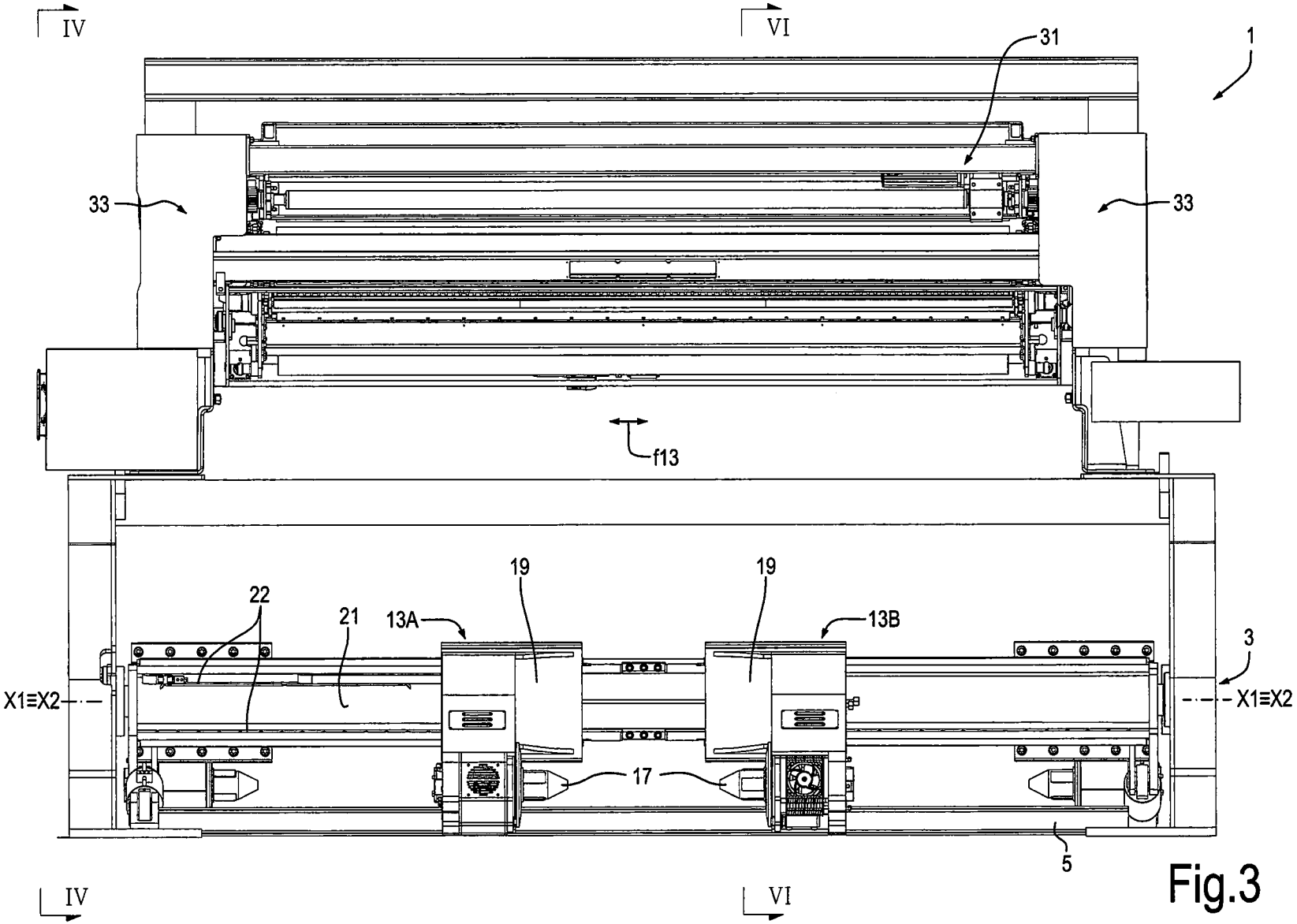
FIG. 3 shows a front view similar to the view shown in FIG. 1, in the working position.
Figure 4:
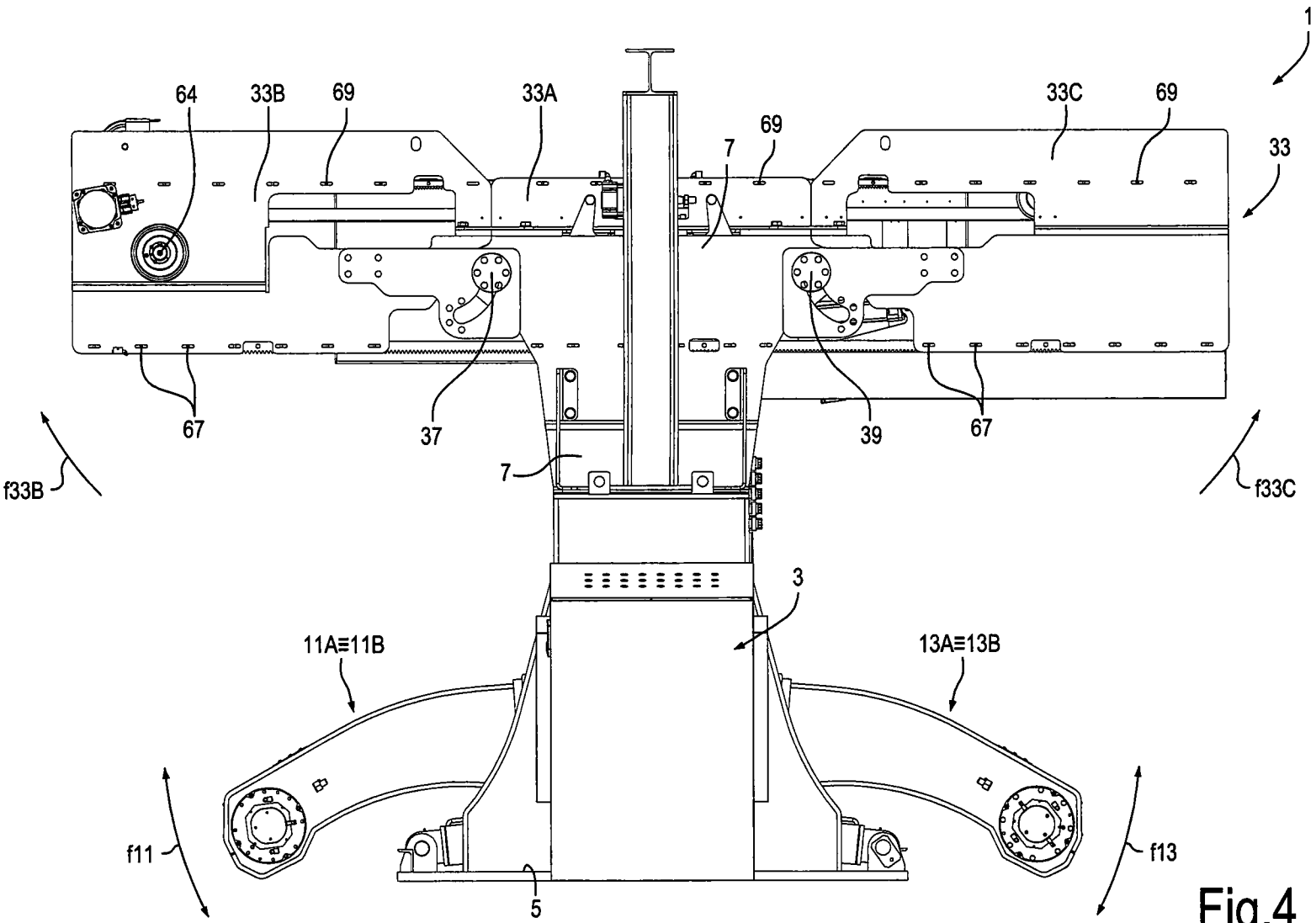
FIG. 4 shows a side view along the line IV-IV of FIG. 3.
Figure 5:
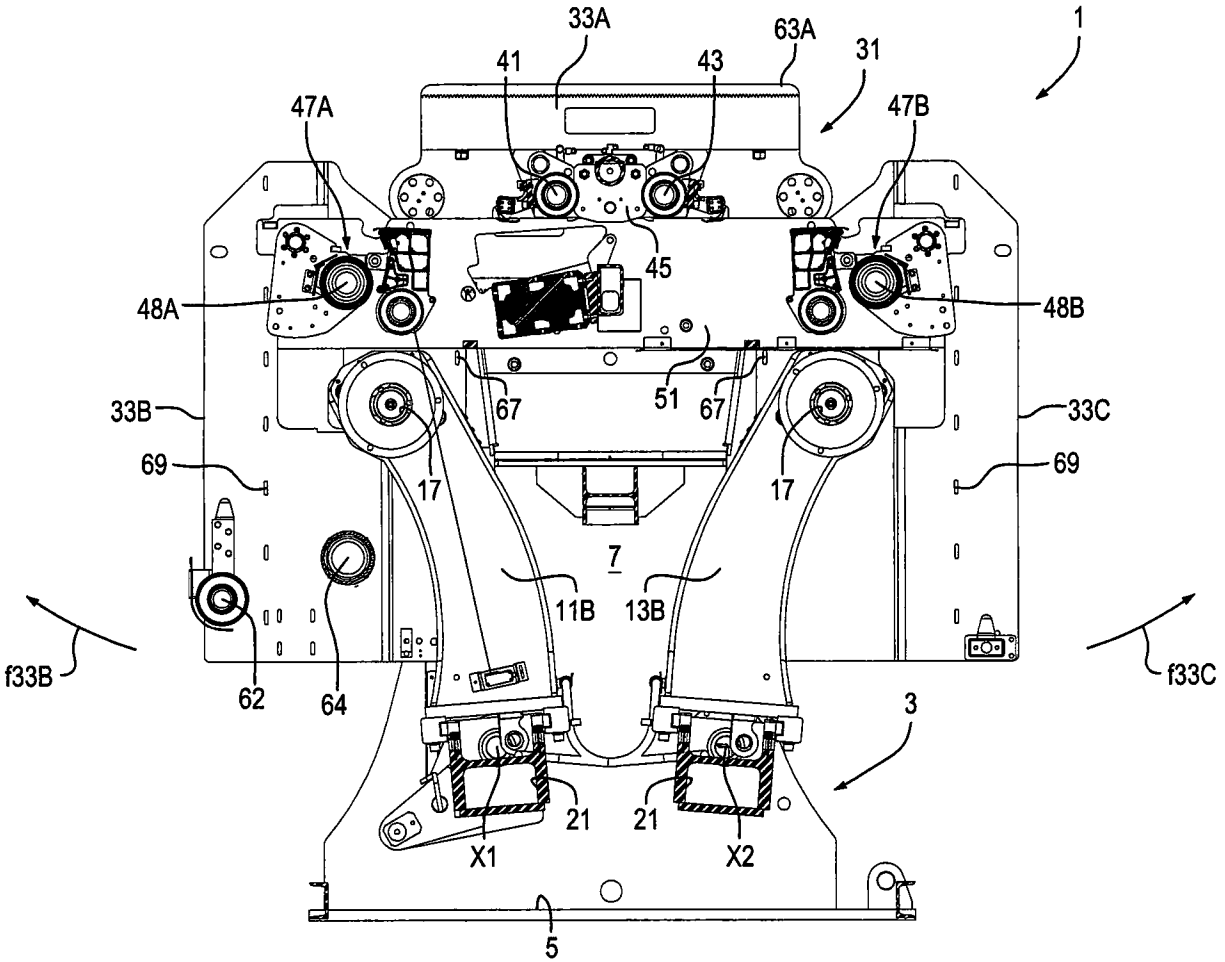
FIG. 5 shows a simplified view, along a mid-line plane V-V of FIG. 2.

An unwinder with a respective integrated splicing machine according to embodiments of the invention is shown in FIGS. 1, 2, 3, 4, 5 and 6. In FIGS. 1, 2 and 5 the unwinder and the respective integrated splicing machine are in a folded position, while in FIGS. 3, 4 and 6 the unwinder and the respective splicing machine are in the working position.

The unwinder 1 comprises a bearing structure 3 with a base 5 and an upright 7. The bearing structure 3 is configured to support a first pair of arms 11A, 11B and a second pair of arms 13A, 13B. The arms 11A, 11B; 13A, 13B are adapted to engage with rolls B1, B2 of web material (FIGS. 7-12, described below) to be unwound in order to feed the web material to a production line (not shown), such as, for example, a corrugated board production line. Each arm 11A, 11B, 13A, 13B is fitted with tailstocks or other axial engagement members 17, for engaging the rolls B1, B2. The arms of each pair of arms 11A, 11B and 13A, 13B, respectively, are hinged to the bearing structure 3 so as to rotate around respective rotation axes X1 and X2, parallel to one another and horizontal, when the unwinder is in operating conditions. To that end, the arms of each pair are mounted on respective beams, indicated by reference number 21, hinged to the bearing structure 3 around the rotation axes X1, X2. Each arm 11A, 11B, 13A, 13B can slide, for example by means of a slide 19 (FIGS. 1 and 3) movable along guides 22 integral with the respective beam 21, such that the mutual distance between the arms 11A, 11B or 13A, 13B of each pair can be adjusted. This makes it possible, in a known manner, to use the arms 11A, 11B; 13A, 13B to engage rolls B1, B2 with different axial dimensions. In FIGS. 1 and 3 the double arrow f13 indicates the movement for adjusting the mutual distance between the arms 13A, 13B.

The rotation around the axes X1, X2 enables the arms 11A, 11B; 13A, 13B to take two positions—maximum raised position (FIGS. 1, 2) and maximum lowered position (FIGS. 3 and 4)—as well as intermediate positions between these two extreme positions. The double arrows F11, F13 in FIG. 4 show the raising and lowering movement of the arms 11A, 11B and 13A, 13B by means of rotation around the axes X1 and X2. The translation and rotation movement of the arms 11A, 11B; 13A, 13B is controlled in a known manner by suitable actuators, not described in detail.

Characteristically, the bearing structure 3 of the unwinder 1 is configured so as to support, in addition to the arms 11A, 11B, 13A, 13B and the respective movement members, also a splicing machine, indicated as a whole by reference number 31 (see FIG. 5). More specifically, in order to support the splicing machine 31, the bearing structure 3 comprises a cross member 33, in one piece with the upright 7. As can be understood from FIGS. 1 and 3, the upright 7 is a double upright, and in the same way the cross member 33 is a double cross member, with a structure approximately symmetrical with respect to a vertical mid-plane of the unwinder, orthogonal to the axes X1, X2. Between the two portions of the cross member 33 and the upright 7 there are positioned the members forming the splicing machine 31, as well as idler rollers for the web materials that are unwound from the rolls placed in the unwinder 1, as described below.

The cross member 33 is divided into three portions. A first central or intermediate portion, indicated by the reference number 33A, is rigidly connected to the upright 7. Two lateral extension portions 33B, 33C of the cross member are bound to the intermediate portion, wherein the lateral extension portions constitute lateral supports for members of the splicing machine 31, as will be clarified below. In the embodiment shown, the lateral portions or lateral supports 33B, 33C are hinged to the intermediate portion 33A so as to rotate around axes that may advantageously be parallel to the rotation axes X1, X2 of the arms 11A, 11B, 13A, 13B. In the embodiment shown, the two lateral supports 33B, 33C are hinged to the intermediate portion 33A of the cross member 33, for example around axes 37 and 39, respectively. The references f33A and f33B are used in FIGS. 2, 4, 5 and 6 to indicate the rotation movements by which the lateral supports 33B and 33C can be brought from a folded, non-operating position, shown in FIGS. 1, 2, and 5, to an operating position, shown in the remaining FIGS. 3, 4, 6-12.

The folded position shown in FIGS. 1, 2, 5 is a transport position, in which the unwinder 1 takes a position requiring a minimal amount of space so that it can be housed in a container, for example. The operating position is that taken by the unwinder when it is in operation. In the folded position (FIGS. 1, 2, 5) the arms 11A, 11B, 13A, 13B are in a raised position, so as to reduce the amount of space they take up. In practice, the arms are found within the volume defined by the upright 7 and do not protrude beyond the folded lateral supports 33B, 33C.

As will become clear from the following description, the passage from the folded position (FIGS. 1, 2, 5) to the operating position does not require anything other than the rotation of the lateral supports 33B, 33C and possibly some other minor operations that are quick and easy to perform.

With a structure of this type it is possible to fully assemble the unwinder 1 in the factory, completing wiring (electrical connections) and hydraulic and/or pneumatic connections. It is therefore also possible to conduct functional tests on the unwinder before shipping it to the place where it will be used.

Since the unwinder does not need to be disassembled for shipping, given that it is sufficient to fold it from the working position (FIGS. 3, 4, 6-12) to the non-operating or folded position (FIGS. 1, 2, 5), when the unwinder is installed on the production line, the parts thereof are already connected and wired. In particular, the splicing machine is already connected to the remaining parts of the unwinder, including the possible on-board computer. There is no need, therefore, to repeat testing operations or other lengthy and complex operations. There is also no need to provide an external bearing structure for the splicing machine to be applied to, and under which to position the unwinder. This is because the unwinder is fitted with its own bearing structure onto which the splicing machine 31 is mounted.

The entire installation process is therefore very fast and can be performed by a small number of personnel, and also by personnel without any particular skill.

As can be seen in particular in FIGS. 6 to 12, on the cross member 31 there are provided various components of the splicing machine 31, some of which may be fixed while others are movable. More specifically, in the embodiment shown, the splicing machine 31 comprises a pair of intermediate rollers 41, 43, arranged on a central operating unit or assembly 45 in a fixed position on the intermediate portion 33A of the cross member 33. The central operating unit or assembly 45 with the two intermediate rollers 41, 43 co-acts with two movable assemblies 47A, 47B of the splicing machine 41. Operation of the components 41-47 is substantially the same as that for the splicing machine disclosed in U.S. Pat. No. 7,441,579, the content whereof is incorporated herein, and therefore will not be described in detail, but referenced briefly in the sequence of FIGS. 7 to 12, from which the differences compared to the operation of splicing machines of the prior art will become clear, said differences mainly concerning the distribution of movements between the various components of the splicing machine.

As can be seen in particular in FIGS. 5 to 12, the two movable assemblies 47A, 47B of the splicing machine 31 are mounted on a carriage 51 provided with a translation movement along the cross member 33, in order to perform the various phases of splicing between web materials coming from rolls supported by the pairs of arms 11A, 11B and 13A, 13B. The carriage 51 is movable along guides 53, at least one of which can be associated with a rack, with engages with the pinion of a motor (not shown), controlling the translation movement of the carriage 51 along the cross member 33.

The guides 53 can be removed from the cross member 33 when it is in the folded position (FIG. 5) and can be fitted onto the cross member 33 when the lateral portions, forming the lateral supports 33B, 33C, are aligned with the intermediate portion 33A (FIGS. 6-12). Fitting and removing the guides and/or racks 53 is a quick and simple operation, which does not require any interventions on the wiring or other connecting elements between parts of the splicing machine 31 and other components of the unwinder 1.

In some embodiments, an idler roller 54 is also supported on the carriage 51, to guide a web material in certain operating conditions.

A slide 55 is also movable along the cross member 33, which carries one or more idler rollers for the web material. In the embodiment shown, the slide 55 carries a first idler roller 57 and a second idler roller 59. The slide 55 can translate along the cross member 33 in a direction f55 parallel to the cross member 55 and therefore orthogonal to the rotation axes X1 and X2 of the arms 11A, 11B and 13A, 13B. The movement of the slide 55 along the cross member 33 can be controlled by a suitable actuator, for example an electric motor 61, which causes a pinion (not shown) to rotate and engage with a rack. The rack can be associated with guides 63 extending along the cross member 33. Like the guides 53, the guides 63 and relative rack can also be removed when the unwinder 1 is in a non-operating position (FIGS. 1, 2, 5) and can be fitted when the cross member 33 is extended with the portions 33A, 33B, 33C aligned and in an operating position (FIGS. 3, 4, 6-12)

The idler rollers 57 and 59, movable along the cross member 33, co-act with two idler rollers 62, 64 fixed to the cross member 33, to form a stock of web material, so as to allow splicing operations between a web material coming from a roll that is nearly empty (or being replaced) and a web material from a roll standing-by, as will be clarified below with reference to a splicing cycle illustrated in the sequence of FIGS. 7 to 12.

Having described the basic components of the unwinder 1, with reference to FIGS. 1, 2, 5 and FIGS. 3, 4, 6, the operations that are performed to bring the unwinder 1 from the non-operating condition to the operating condition will now be illustrated. In FIGS. 1, 2, 5 the arms 11A, 11B, 13A, 13B are turned upwards so as to occupy the minimum space possible, substantially next to the upright 7 or at least partially inside it. In this position the lateral portions of the cross member 33, forming the lateral supports 33B, 33C, can be folded downwards thereby minimizing the size of the unwinder 1. The guides and the racks for the carriage 51 and for the slide 55 can be at least in part removed from the machine, and in particular the portions that are coupled to the lateral supports 33B, 33C can be separated. The carriage 51 is in an intermediate position, and is supported by a portion of the guide 53 which remains in one piece with the central or intermediate portion 33A of the cross member 33. The slide 55 can also be supported on the central portion 33A of the cross member 33, or it can be removed. In the example shown, the slide 55 has been removed.

The unwinder 1 is brought from the folded condition shown in FIGS. 1, 2, 5 to the operating position by means of the following simple operations. The lateral portions of the cross member 33, which form the lateral supports 33B, 33C, are rotated upwards according to arrows f33B f33C (FIGS. 2, 4) and fixed in a horizontal position, aligned with the intermediate portion 33A of the cross member 33. The guides and racks 53, 63, or portions thereof, that may have been removed from the unwinder 1, can be mounted to obtain the configuration shown in FIGS. 6-12. FIG. 4 shows a situation in which the racks and guides are still removed. The reference numbers 67, 69 indicate (FIGS. 2, 4, 5) through-holes or slots for fastening organs of the guides and racks for the carriage 51 and for the slide 55.

Figure 6:
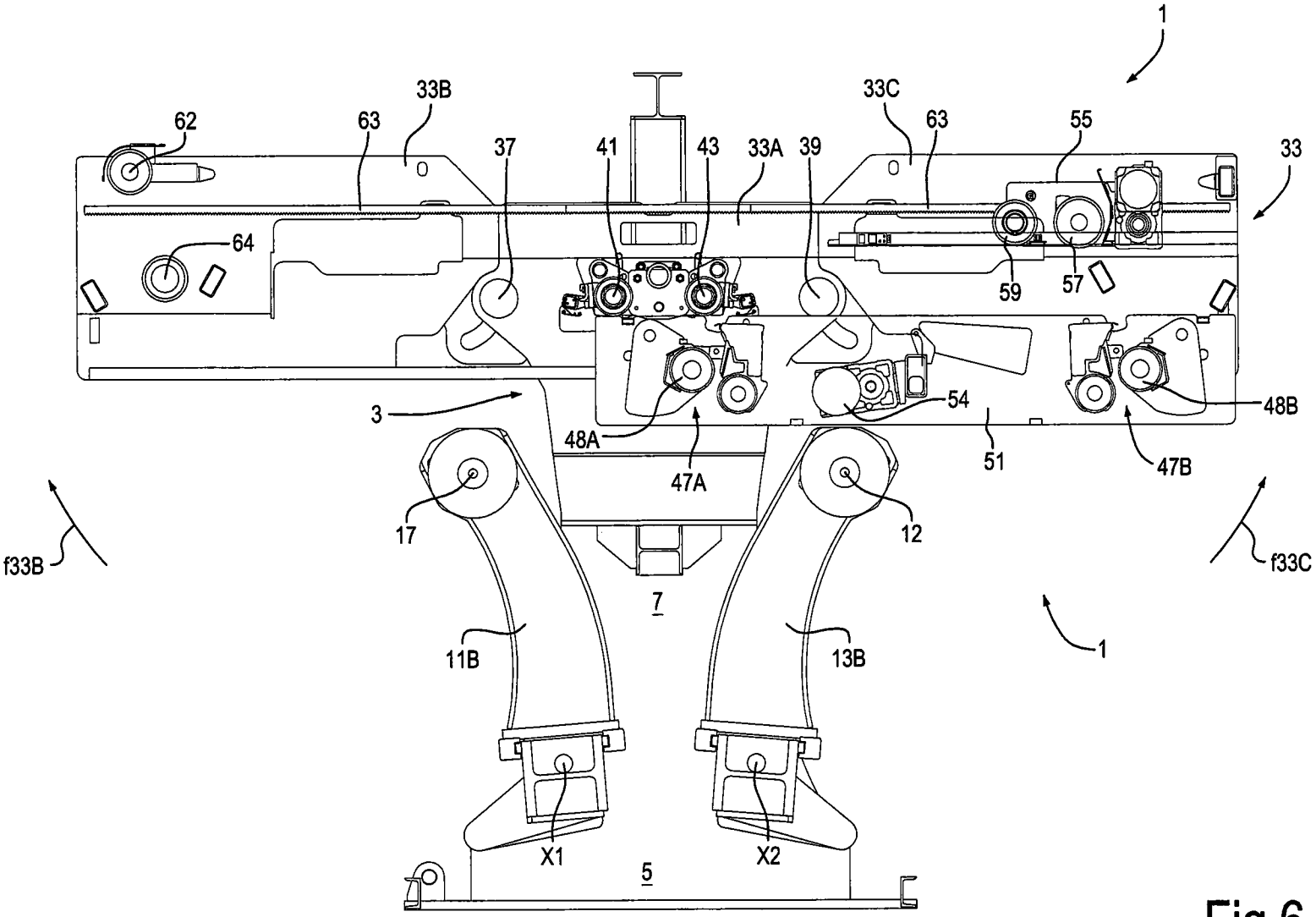
FIG. 6 shows a simplified view, along a mid-line plane VI-VI of FIG. 3.

In FIG. 6 the arms 11A, 11B, 13A, 13B are still raised. They are then lowered to manipulate the rolls B1, B2 as described below.

FIGS. 7 to 13 show an operating cycle of the splicing machine of the unwinder 1.

Figure 7:
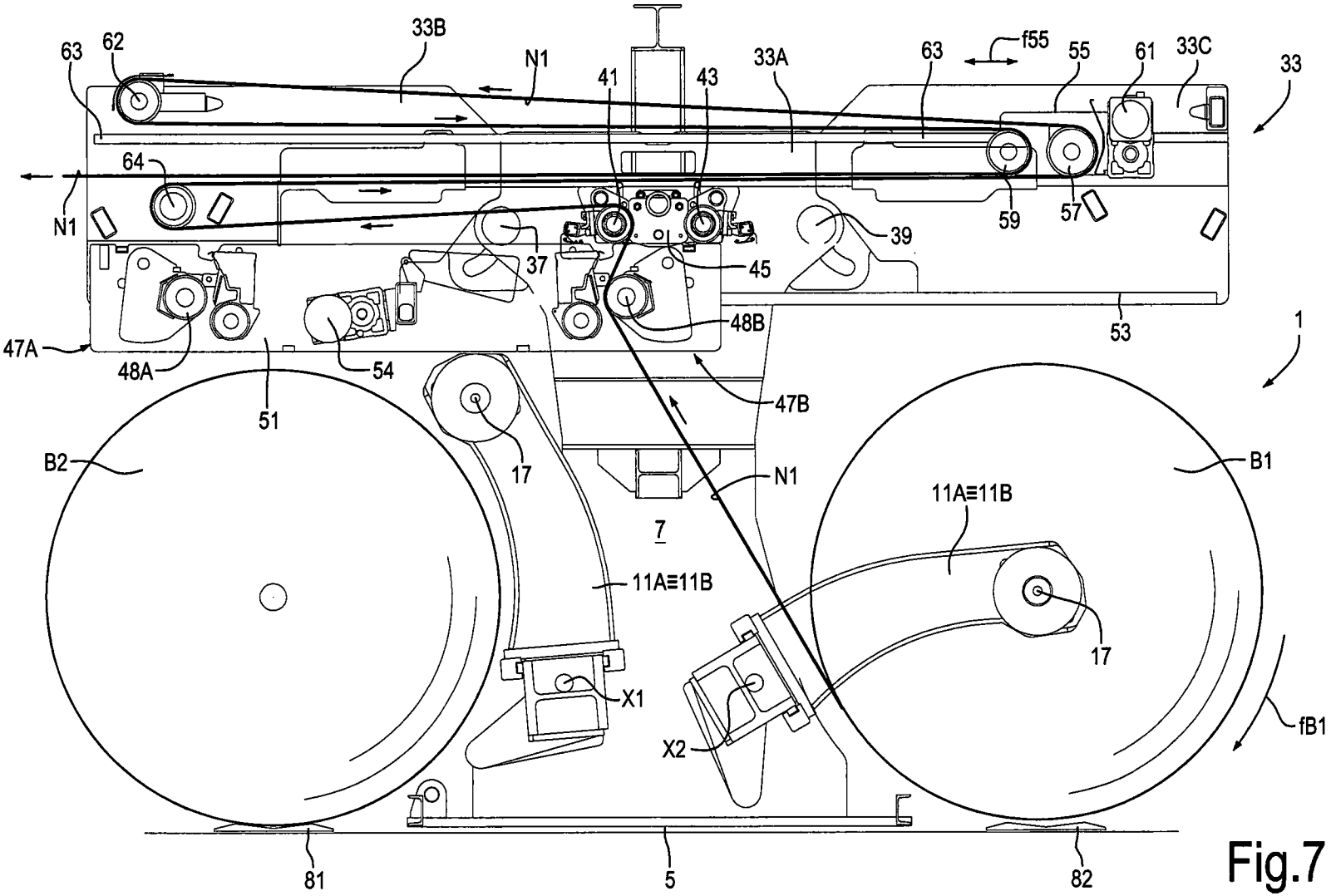
FIGS. 7, 8, 9, 10, 11, 12 show a sequence of splicing and replacement of working rolls in a cross-section similar to FIG. 6.

In FIG. 7 the roll B1 is working and rotates (arrow fB1 to unwind the web material N1 and feed it to a production line (not shown). The roll B1 is engaged by the arms 13A,13B, which hold it raised from the ground to allow rotation thereof, for example by traction. The web material N1 is guided around a roller 48B of the movable assembly 47B, around the intermediate roller 43, around the fixed idler rollers 62, 64, and around the movable idler rollers 57, 59, to provide a stock of web material N1.

A second roll B2 of web material has been inserted into the unwinder 1 and is resting on the ground, for example on a conveyor belt 81, to be engaged by the arms 11A, 11B temporarily in a non-operating position.

Figure 8:
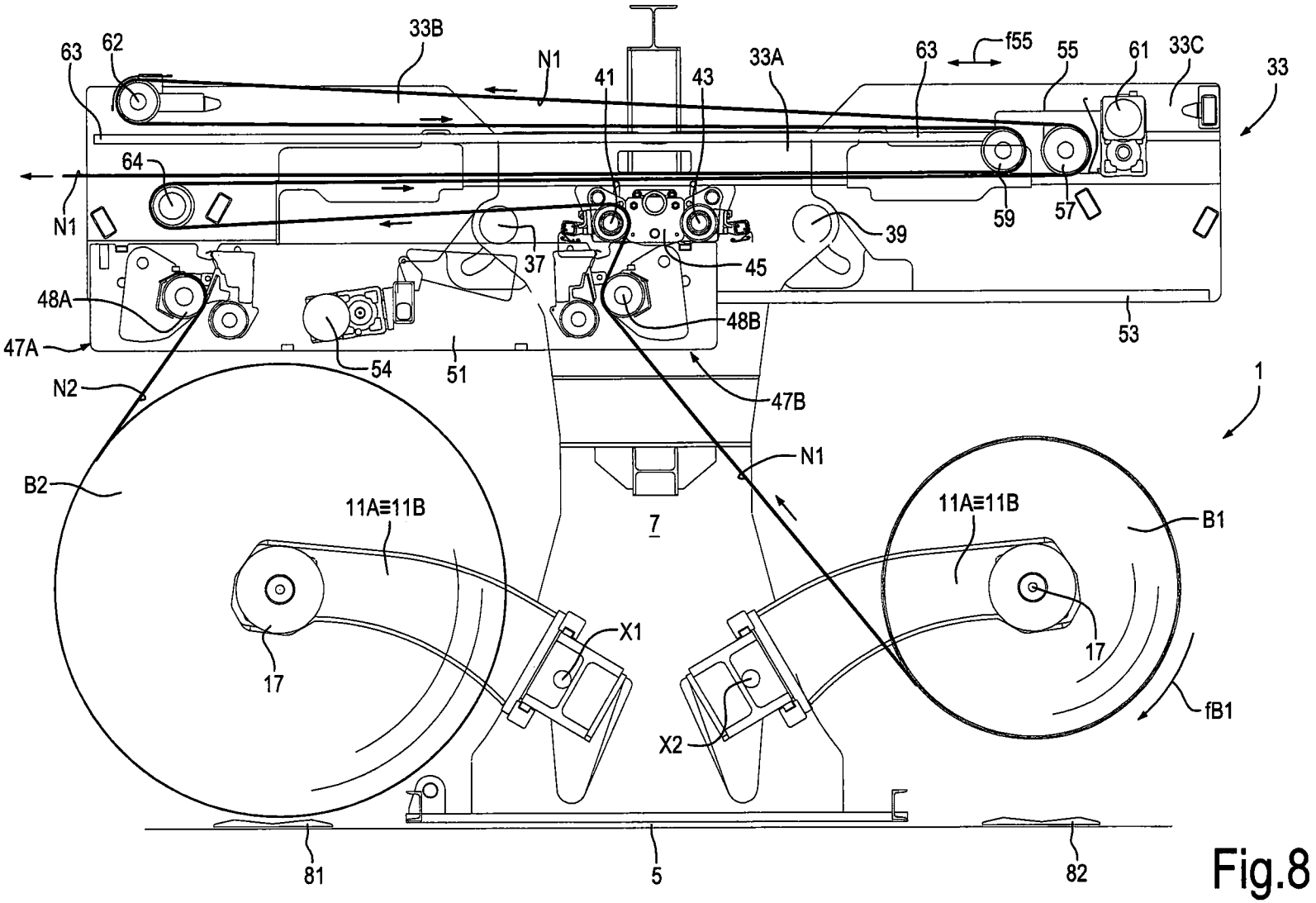

FIG. 8 shows a subsequent phase, in which the roll B1 has been partially unwound, while the head of a web material N2 wound on roll B2 has been prepared and is held by the movable assembly 47A. The roll B2 has been engaged by the arms 11A, 11B and is raised with respect to the conveyor 81, to allow rotation thereof.

Figure 9:
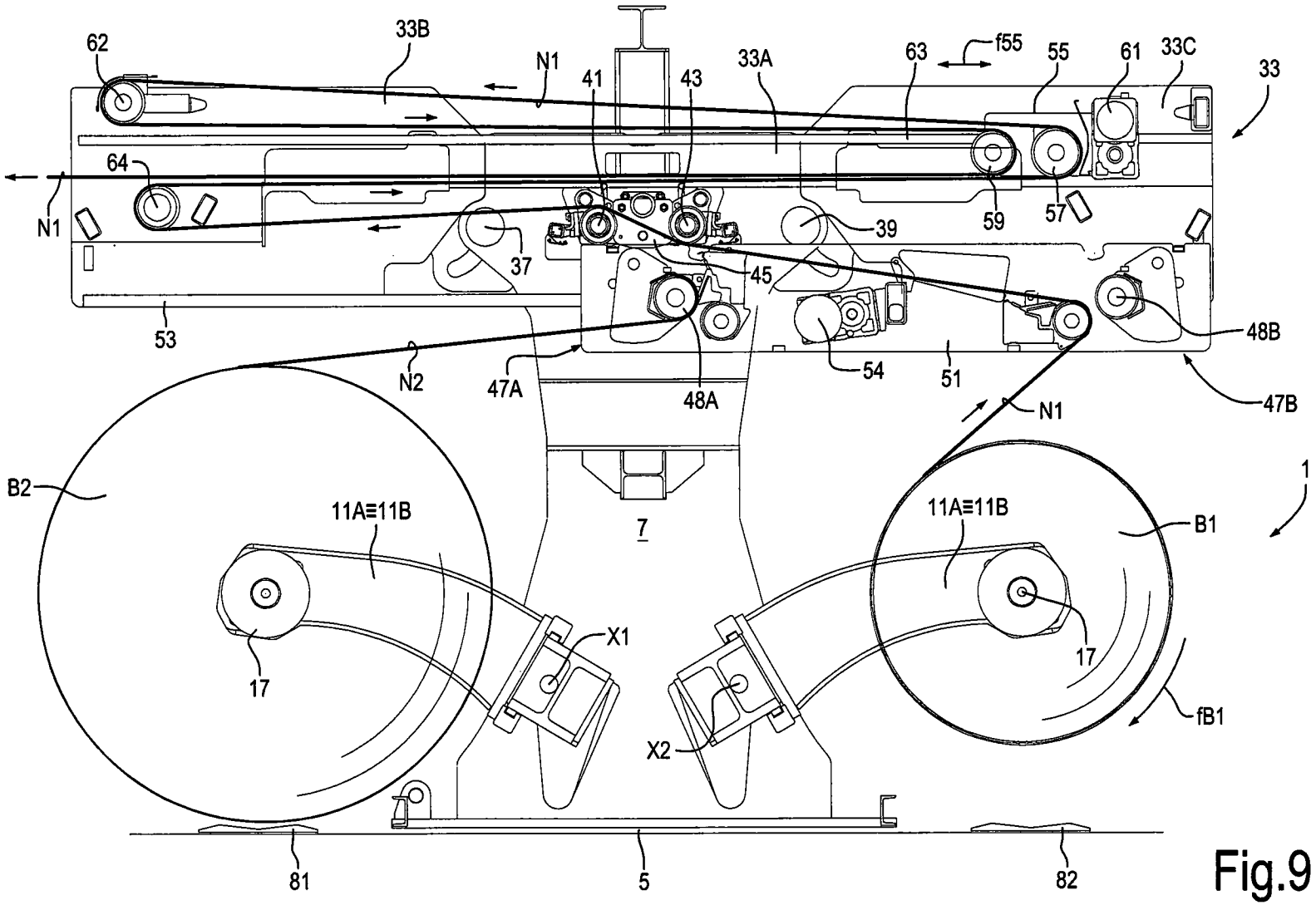

In FIG. 9 the movable assembly 47B of the splicing machine 31 has moved from the central position to a lateral position, on the lateral support 33B of the cross member 33. The central portion 33A of the cross member 33 is therefore free to allow the translation of the movable assembly 47A to the central position. In this position, with a known operating sequence (see e.g. U.S. Pat. No. 7,441,579) the head of the web material N2 is spliced to a tail of the material N1, which is generated by cutting the web material delivered by the roll B1.

Figure 10:
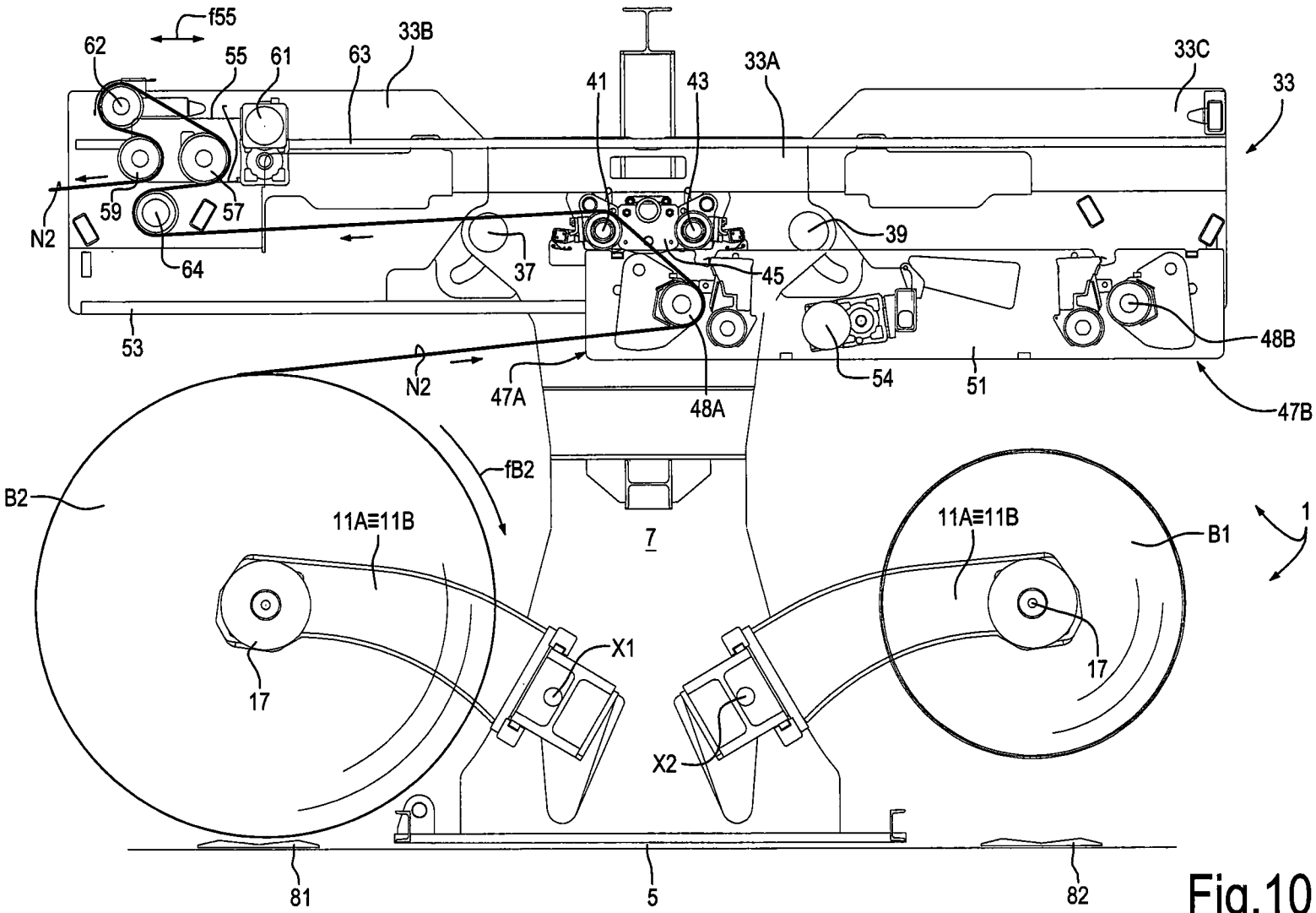

Once the material N2 has been spliced to the material N1, the roll B2 begins to rotate delivering the web material N2, while the roll B1 can stop. This phase is shown in FIG. 10. Reference fB2 is used to indicate the direction of rotation of the unwinding roll B2. The splicing phase of the web materials N1, N2, which is performed between FIG. 9 and FIG. 10 requires a temporary stoppage or slowing down of the web material N1, N2. To prevent impacts downstream on the production line, during this phase the stock of web material N1 formed between the rollers 48B, 43, 64, 57, 62, 59 is used. This is made possible by the translation of the movable guide rollers 57, 59 from the position shown in FIG. 9 (on the right-hand support 33C) to the position shown in FIG. 10 (on the left-hand support 33B).

Figure 11:
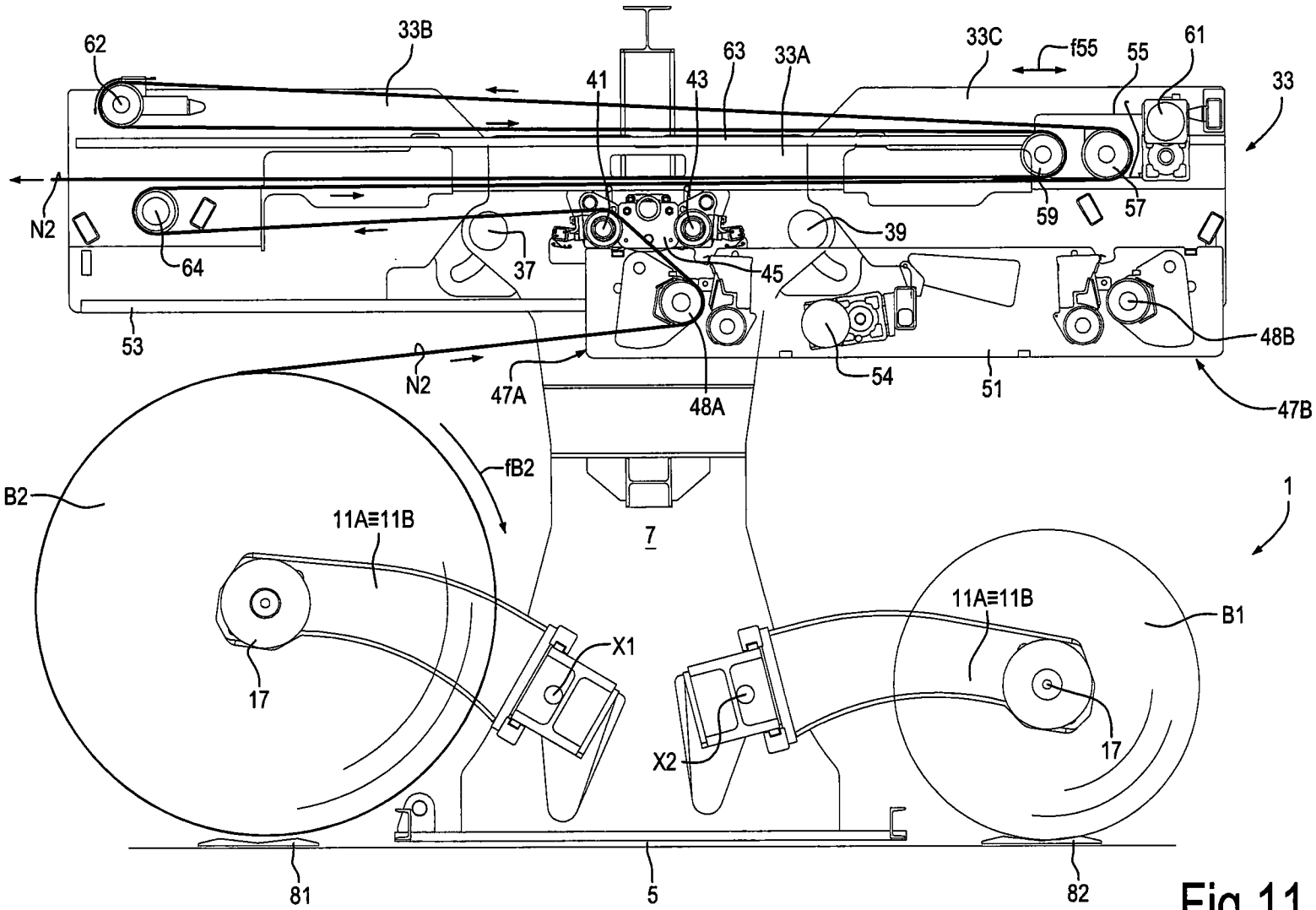
Figure 12:
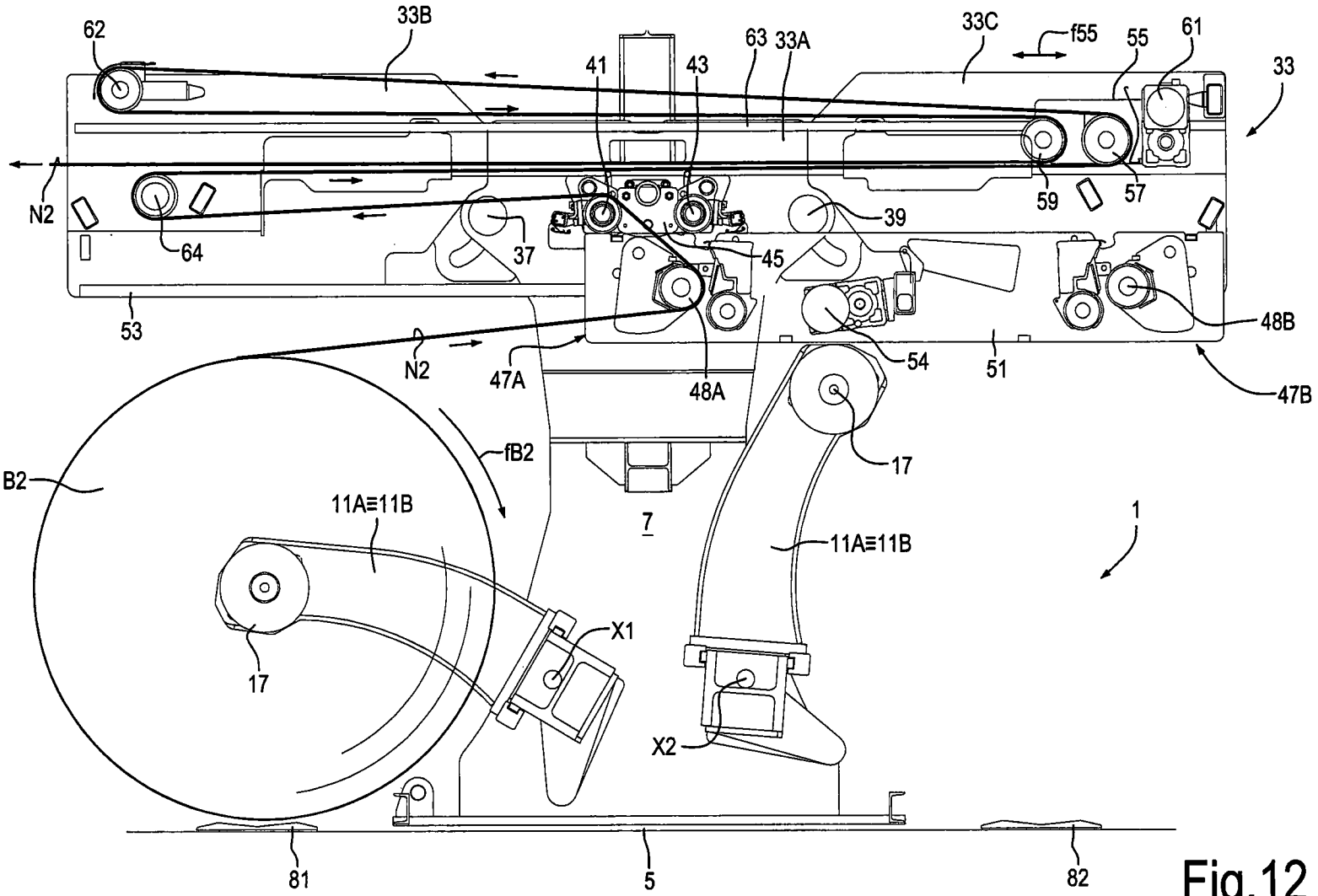

Subsequently (FIG. 11) the stock of web material N2 is restored, by translating from left to right the slide 55 with the movable idler rollers 57, 59, which return to the left-hand support 33C. In FIG. 11 the roll B1 has been lowered by the arms 13A, 13B and, for example, released onto a conveyor 82, similar to the conveyor 81.

The roll B1 can be removed from the unwinder (FIG. 12) to be replaced by another roll for the next cycle.

As can be seen from the sequence of FIGS. 7 to 12, the roll B2 is replaced by the roll B1 when the latter is not yet exhausted. This is because replacement of one roll with another can be done for various reasons, and not only when the roll is exhausted. For example, the roll B1 may be replaced if the web material N1 breaks, or if the production line downstream requires the replacement of one type of material (N1, roll B1) with another (N2, roll B2).

What is claimed is:

1. An unwinder of rolls comprising:

a bearing structure;

two pairs of arms supported movable on the bearing structure and each of said two pairs of arms comprising members for axial engagement of a roll;

a splicing machine;

a slide;

wherein the bearing structure comprises a base and an upright extending from the base, on which a cross member is supported; wherein the cross member comprises an intermediate portion rigidly bound to the upright and a pair of lateral supports adapted to take at least an operating position and a non-operating position, with respect to the intermediate portion of the cross member; wherein the slide is movable along the intermediate portion and the lateral supports of the cross member, and wherein the slide carries at least one idle roller for guiding web material.

2. The unwinder of claim 1, wherein the splicing machine is supported by said cross member and comprises parts movable along the intermediate portion and the lateral supports of said cross member.

3. The unwinder of claim 2, wherein in the operating position the lateral supports are aligned with the intermediate portion of the cross member; and wherein in the non-operating position the lateral supports are oriented towards the base of the bearing structure, in a folded position.

4. The unwinder of claim 2, wherein each arm of each of the two pairs of arms are connected to the bearing structure around a respective rotation axis.

5. The unwinder of claim 1, wherein in the operating position the lateral supports are aligned with the intermediate portion of the cross member; and wherein in the non-operating position the lateral supports are oriented towards the base of the bearing structure, in a folded position.

6. The unwinder of claim 1, wherein the slide carrying the at least one idle roller moves along guides extending along the lateral supports and a central portion of the cross member.

7. The unwinder of claim 1, wherein each arm of each of the two pairs of arms are connected to the bearing structure around a respective rotation axis.

8. The unwinder of claim 7, wherein each arm of each of the two pairs of arms are movable with respect to the bearing structure in a direction parallel to the axes of rotation.

9. The unwinder of claim 7, wherein the lateral supports are hinged to the upright, or hinged to the intermediate portion of the cross member, around axes parallel to the rotation axes of the arms.

10. The unwinder of claim 1, wherein the splicing machine comprises a central operating assembly, placed in a stationary position with respect to the upright and to the cross member, and two movable assemblies provided with movement along the cross member and selectively positionable in one of the lateral supports and in the intermediate portion of the cross member, in order to co-act with the central operating assembly.

11. The unwinder of claim 10, wherein the two movable assemblies are arranged on guides extending partly onto the lateral supports and partly onto the intermediate portion of the cross member.

12. The unwinder of claim 11, wherein the two movable assemblies are mounted on a slide movable along said guides.

13. The unwinder of claim 1, wherein guide rollers for web material wound on the rolls are arranged on the cross member.

14. The unwinder of claim 13, wherein at least one of said guide rollers is carried by a slide movable along guides extending along the cross member, partly rigidly connected to the intermediate portion and partly connected to the lateral supports.

15. An unwinder of rolls comprising:

a bearing structure;

two pairs of arms supported movable on the bearing structure and each of said two pairs of arms comprising members for axial engagement of a roll;

a splicing machine;

wherein the bearing structure comprises a base and an upright extending from the base, on which a cross member is supported; wherein the cross member comprises an intermediate portion rigidly bound to the upright and a pair of lateral supports adapted to take at least an operating position and a non-operating position, with respect to the intermediate portion of the cross member; wherein the splicing machine comprises a central operating assembly, placed in a stationary position with respect to the upright and to the cross member, and two movable assemblies provided with movement along the cross member and selectively positionable in one of the lateral supports and in the intermediate portion of the cross member, in order to co-act with the central operating assembly.

16. An unwinder of rolls comprising:

a bearing structure;

two pairs of arms supported movable on the bearing structure and each of said two pairs of arms comprising members for axial engagement of a roll;

a splicing machine;

wherein the bearing structure comprises a base and an upright extending from the base, on which a cross member is supported; wherein the cross member comprises an intermediate portion rigidly bound to the upright and a pair of lateral supports adapted to take at least an operating position and a non-operating position, with respect to the intermediate portion of the cross member; wherein the splicing machine is arranged on the cross member; and wherein the splicing machine comprises an assembly movable along said cross member.

* * * * *